United States Patent [19]

Scholz et al.

[11] 4,158,789

[45] Jun. 19, 1979

[54] METAL HALIDE ARC DISCHARGE LAMP

[75] Inventors: John A. Scholz, Danvers, Mass.; Phillip J. Gardner, Cupertino, Calif.

[73] Assignee: GTE Sylvania Incorporated, Stamford, Conn.

[21] Appl. No.: 859,275

[22] Filed: Dec. 12, 1977

[51] Int. Cl.[2] ..... H01J 61/06

[52] U.S. Cl. ..... 313/218; 313/229; 313/346 R

[58] Field of Search ..... 313/218, 346 R, 229; 29/25.14

[56] References Cited

U.S. PATENT DOCUMENTS 3,134,924 5/1964 Henderson et al. ..... 313/218 X

FOREIGN PATENT DOCUMENTS 49-17062 4/1974 Japan ..... 313/218

*Primary Examiner*—Rudolph V. Rolinec
*Assistant Examiner*—Darwin R. Hostetter
*Attorney, Agent, or Firm*—James Theodosopoulos

[57] ABSTRACT

A high intensity arc discharge lamp comprises an arc tube having tungsten electrodes at each end and containing a fill including mercury, a starting gas and a metal in the form of metal halide. The tungsten electrode also contains a small quantity of said metal in solid solution with the tungsten.

3 Claims, 1 Drawing Figure

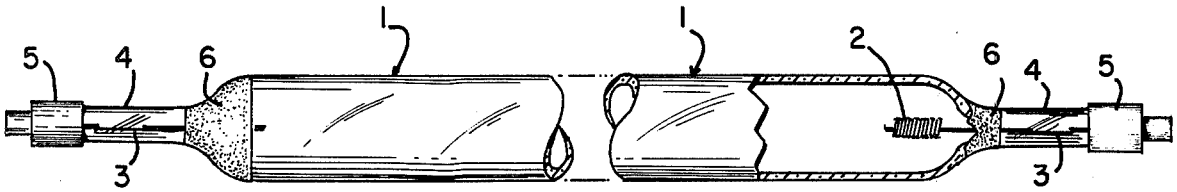
5
4
6
1
1
2
6
4
5
3
3

METAL HALIDE ARC DISCHARGE LAMP

THE INVENTION

This invention concerns high intensity metal halide arc discharge lamps. Such lamps comprise a quartz arc tube having electrodes at each end and containing a fill including mercury, metal in the form of a halide and a starting gas. It is known that the presence of iron in the form of iron halide in the lamp fill of an ultraviolet emitting arc discharge lamp enhances ultraviolet emission, as shown in U.S. Pat. No. 3,590,307. However, a problem with such iron-containing lamps is that maintenance deteriorates with life. A purpose of this invention is to prevent or minimize such maintenance deterioration.

In an ultraviolet emitting lamp in accordance with this invention, in addition to the iron halide in the arc tube fill, a small quantity of iron is contained in the tungsten electrode, preferably in solid solution therewith. The iron should not be merely attached to the electrode, as, for example, a chip welded thereto, since it could cause darkening of the arc tube wall proximate the electrode during life.

The single FIGURE in the drawing is an elevational view partly in section of a lamp in accordance with this invention.

The ultraviolet emitting arc discharge lamp shown in the drawing comprises a quartz arc tube 1 having tungsten electrodes 2 at its ends. Electrodes 2 are connected to lead-in conductors 3 embedded in seals 4 and are in electrical connection with external contacts 5. The usual infrared-reflecting coating 6 can be disposed around and behind electrode 2 at each end of arc tube 1. Arc tube 1 contains a fill including mercury, iron in the form of iron halide, and a starting gas. Tungsten electrode 2 contains a small quantity of iron in solid solution therewith.

In one example for a 3600 watt lamp, arc tube 1 was about 13" long having a 12" arc length, and had an inside diameter of 22 mm. The volume of arc tube 1 was about 125 cc. The arc tube fill was 0.225 mg/cc of iron iodide ($FeI_2$), 1.83 mg/cc of mercury and 9 torr of argon. Electrode 2 consisted of a tungsten rod 45 mils in diameter having a tungsten coil overwound thereon, the coil being 116 mils in diameter by 3/8" long. The coil aided in controlling electrode temperature during operation. Iron was dissolved in electrode 2 in the following manner. The electrodes were vacuum coated with about 2000 angstroms of high purity iron and were then placed in an inert atmosphere furnace at about 1700° C. to allow the iron to diffuse into the body of the tungsten electrode. They were then connected to conductors 3 and sealed into arc tube 1 in the usual manner.

A comparison of lamps as per this invention was made with lamps not having iron dissolved in the electrodes. After 700 hours operation, the UV output of the lamps as per this invention, at both the 400 and 360 nanometer regions, did not decrease. In contrast, in the lamps without iron in the electrodes, the UV output in the 400 nm region decreased 8% after 700 hours operation, and the output in the 360 nm region decreased 13.5%.

This technique of incorporating metal in the tungsten electrode can be used for other metals beside iron, provided that its halide has similar thermochemical stability as iron halide and provided that the metal dissolves in solid tungsten. Examples of such metals are titanium, chromium, cobalt and nickel.

We claim:

1. An ultraviolet emitting arc discharge lamp comprising an arc tube having tungsten electrodes at each end and containing a fill including mercury, iron in the form of iron halide and a starting gas, the tungsten electrode containing a small quantity of iron, wherein the small quantity of iron is in solid solution with the tungsten.

2. A high intensity arc discharge lamp comprising an arc tube having tungsten electrodes at each end and containing a fill including mercury, a starting gas and a metal in the form of metal halide, the tungsten electrode containing a small dissolved quantity of said metal for the purpose of improving lamp maintenance.

3. The lamp of claim 2 wherein said metal was vacuum deposited on said tungsten electrode and diffused thereinto prior to sealing in of said tungsten electrode to said arc tube.

* * * * *